US006712545B2

(12) United States Patent
Muller et al.

(10) Patent No.: US 6,712,545 B2
(45) Date of Patent: Mar. 30, 2004

(54) SAFETY BARRIER TRANSITION FOR PROVIDING AN EASILY REMOVABLE CLOSURE OF ROAD GAPS

(76) Inventors: Franz Muller, Via F. Bracca, 23, 20056 Trezzo sull'Adda (Milan) (IT); Marco Anghileri, Via F. Bracca, 23, 20056 Trezzo sull'Adda (Milan) (IT)

( * ) Notice: Subject to any disclaimer, the term of this patent is extended or adjusted under 35 U.S.C. 154(b) by 0 days.

(21) Appl. No.: 10/095,798

(22) Filed: Mar. 11, 2002

(65) Prior Publication Data

US 2002/0127056 A1 Sep. 12, 2002

(30) Foreign Application Priority Data

Mar. 12, 2001 (IT) ..... MI2001A0521

(51) Int. Cl.[7] ..... E01F 13/04
(52) U.S. Cl. ..... 404/6; 256/13.1
(58) Field of Search ..... 404/6, 9, 10, 11; 256/1, 13.1

(56) References Cited

U.S. PATENT DOCUMENTS 5,531,540 A * 7/1996 Wasserstrom et al. ..... 256/13.1
5,547,310 A * 8/1996 Muller ..... 256/13.1
5,685,665 A * 11/1997 Lembo ..... 256/13.1
6,059,491 A * 5/2000 Striefel et al. ..... 256/13.1
6,164,865 A * 12/2000 McCallum ..... 404/6
6,203,242 B1 * 3/2001 Englund ..... 256/13.1
6,293,727 B1 * 9/2001 Albritton ..... 404/6
6,402,421 B1 * 6/2002 Ottavi et al. ..... 256/13.1

FOREIGN PATENT DOCUMENTS

DE 4333577 A1 * 4/1995 ..... E01F/15/10
EP 758698 A1 * 2/1997 ..... E01F/15/12
FR 2701499 A1 * 8/1994 ..... E01F/13/00
FR 2741093 A1 * 5/1997 ..... E01F/15/10

* cited by examiner

*Primary Examiner*—Thomas B. Will
*Assistant Examiner*—Alexandra K. Pechhold
(74) *Attorney, Agent, or Firm*—Hedman & Costigan, P.C.

(57) ABSTRACT

A safety barrier transition, comprising partially deformable elements, pivoted by quickly disengageable coupling elements to a fixed barrier, specifically designed for closing, under safety conditions, and quickly re-opening road gaps provided in superhighway traffic dividers.

4 Claims, 4 Drawing Sheets

SAFETY BARRIER TRANSITION FOR PROVIDING AN EASILY REMOVABLE CLOSURE OF ROAD GAPS

BACKGROUND OF THE INVENTION

The present invention relates to a barrier transition for removably closing road gaps and other passage areas through safety barriers.

As is known, superhighways, freeways and two-carriageway roads in general are protected at their central riserve by safety barriers which can be made of a concrete mix, usually a reinforced concrete mix or, more frequently, a metal material, depending on light and heavy vehicle containment characteristics, and on personal safety standards, defined by national and European rules.

The above protective systems are interrupted, at preset distances, by paved areas to allow transiting vehicles to switch off the carriageway, when conditions are required.

The above mentioned areas are usually called "traffic divider gaps", and have an average span from 20 to 40 m.

The frequency with which the mentioned road gaps occur through the safety barrier, depends on environment conditions, maintenance requirements, provided outlets or the like and, usually corresponds to a rather small spacing, i.e. about a gap each two road kilometers.

Thus, said road gaps actually represent a discontinuity through the side protective system designed for preventing transiting vehicles from stepping over the traffic divider, i.e. the safety barrier.

Such a discontinuity is very dangerous, since traffic accidents, caused by vehicles traversing the road gap, even if they occur with a rather small rate, have very deleterious effects and, because of the continuously increasing vehicle traffic, are anyhow very significative since, in such a case, an uncontrolled vehicle accidentally traversing a read gap, will probably impact against one or more other vehicles driven in the opposite direction on the other carriageway, thereby the sum of the kinetic energies of the impacting vehicles will be such as to cause fatal consequences for the vehicle passengers.

Moreover, if the starting portions of the safety barrier at the ends of the road gaps are not suitably protected, for example by impact attenuators, then an impact against these regions would frequently have very serious consequences for the vehicle passengers.

Thus, in order to overcome the above problems the possibility of eliminating the mentioned road gaps and closing them by fixed constructions of a conventional barrier type has been already considered.

Such an approach, however, could not be a viable one, for example because of emergency and snow removal vehicle circulating problems, to allow vehicles to switch off their carriageway in serious accident conditions in which the carriageway would be interrupted for a long time, and for long duration maintenance operations, requiring the provision of a counter-lane on the opposite carriageway.

Thus, for safety purposes, it is absolutely necessary to provide the road users with an efficient closure system which, on the other hand, can be easily and quickly removed, for example in urgency situations.

Disassemblable metal conventional barriers are commercially available, which, however, do not allow to provide an easy and quick opening of the barrier since, for disassembling them, it would be necessary to remove a comparatively high number of barrier coupling elements. In this connection it should be moreover pointed out that the mentioned coupling elements, being subjected to atmospheric and polluting agents, would render much more difficult a snap operating intervention.

Fixed cable barriers have been also used in some countries with rather good safety results; however this prior technology disclosed, for example, in EP 369659 (British Ropes) does not allow to make easily removable barrier systems, thereby does not solve the existing barrier problems.

A cable safety system which has been specifically designed to overcome the above problems is that disclosed in the Italian Patent No. 1,270,041 and in WO 00/23658 (PCT) to Snoline. This system, however, does not solve the problems affecting large width road gaps since in an impact situation, it provides comparatively great dynamic deforming cambers.

SUMMARY OF THE INVENTION

Accordingly, the aim of the present invention is to solve the above mentioned problems, by providing a barrier transition for removably closing road gaps, adapted to resist, in a completely safe condition, against impacts, as required by international rules for light and average weight vehicles, such as motor vehicles and busses, and which, in the meanwhile, can be either completely or partially removed, in a short time without requiring either specifically designed complex tools or skilled operators.

Within the scope of the above mentioned aim, a main object of the present invention is to provide such a barrier transition which, owing to its specifically designed constructional features, is very reliable and safe in operation.

Yet another object of the present invention is to provide such a barrier transition which can be easily made starting from easily available elements and materials and which, moreover, is very competitive from a mere economic standpoint.

According to one aspect of the present invention, the above mentioned aim and objects, as well as yet other objects, which will become more apparent hereinafter, are achieved by a barrier transition for removably closing road gaps, characterized in that said barrier transition comprises suitably contoured protective longitudinal elements arranged symmetrically to a road gap closure line, said protective elements being coupled to one another so as to provide a longitudinally rigid barrier having impact force transmitting end portions.

Said protective elements have advantageously a length equal to that of standard safety metal barriers, i.e. usually of 4 m, and a conventional double or triple corrugation cross-section, and an optional vertically extending multiple pattern.

The protective elements are coupled in opposite pairs, by rigid connection means, such as screws engaged in holes provided near their end portions, and the element pairs are coupled by special blocks which, on a side, are rigidly clamped by screws to the holes of said elements and, on the other side, support either one or two vertical hinge assemblies.

Said hinge assemblies, of strong construction, connect the system to allow it to transmit through said protective elements the stresses from an impacting vehicle, thereby providing a comparatively high flexural stiffness, to in turn reduce the maximum dynamic camber.

Thus, the system substantially operates as a flexible barrier, which is exclusively stressed by tension and strained through a resilient range.

The pin of the hinge assembly can be easily removed to quickly either partially or fully open the transition barrier (i.e. to remove one or more elements thereof), for allowing traffic to pass therethrough.

Each longitudinal protective element is coupled to two vertically extending feet, arranged near its end portions and supporting it on the ground thereon it can freely slide.

To facilitate the opening movement, some or all said feet can comprise a plurality of wheels the height of which can be adjusted by a suitable raising or lifting mechanism coupled to said feet or to said longitudinal protective elements, to allow said wheels to contact the ground, in an extended position thereof, only as the road gap is opened. The wheels can moreover comprise a brake for preventing spontaneous movements on an inclined ground.

To the end elements of the transition, which transition can have any desired length, depending on the existing road gap size, transition fitting of any suitable shape designed to provide a safe connection to the fixed barrier are coupled, said fittings comprising the same panels as said fixed metal barrier having a double or triple corrugation construction, or different modified panels for concrete barriers, in each case provided in a suitable number and arrangement of the holes for coupling and transmitting the impact force to be dissipated by the extended fixed barrier, which, usually, has a length of the order of at least few hundred meters, but which, most probably, continuously extends up to the following road gap with a length of at least two kilometers.

If the existing barrier pertains to a less class and, accordingly, is too weak to absorb the impact force, then it would be anyhow possible to discharge to the ground said impact force, by coupling the transition end elements to a strong pole ground driven or coupled to a suitable foundation adding optional dissipating elements, for providing protection against a local side impact.

If only a portion of the road gap shall be opened, then it is advantageously possible to use a suitable removable pole, to be driven into the ground through a driving pole bush, for anchoring therein the transition portion remaining as the barrier gap is opened.

To further decrease the dynamic camber, the system can also comprise intermediate binding elements, including further removable ground driven poles for reducing the overall system working length and, accordingly, its dynamic deformation.

BRIEF DESCRIPTION OF THE DRAWINGS

Further characteristics and advantages of the barrier according to the present invention will become more apparent hereinafter from the following disclosure of a preferred, though not exclusive, embodiment of a barrier transition for removably closing road gaps, which is illustrated, by way of an indicative, but not limitative, example, In the figures of the accompanying drawings, where.

DESCRIPTION OF THE PREFERRED EMBODIMENTS

Figure 1:
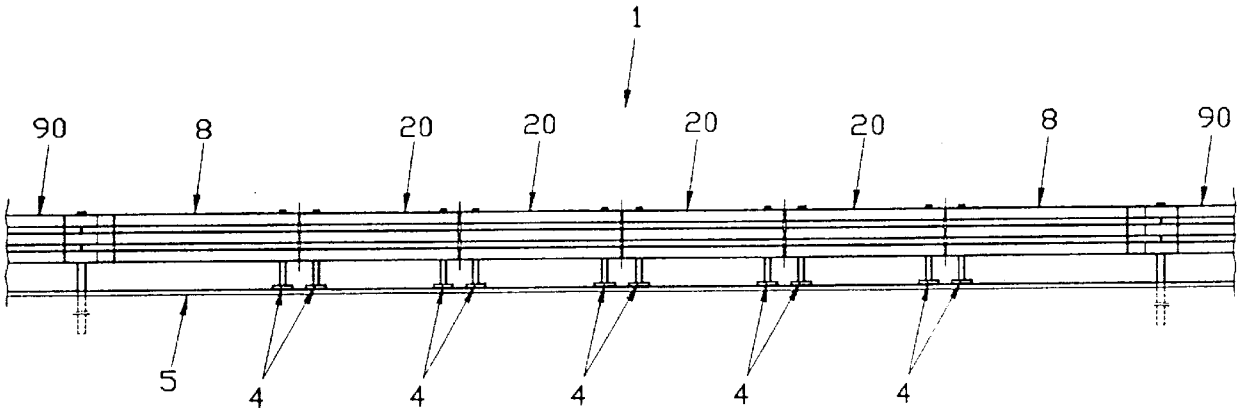
FIG. 1 schematically shows a road gas with the barrier transition according to the invention, as seen in elevation.
Figure 2:
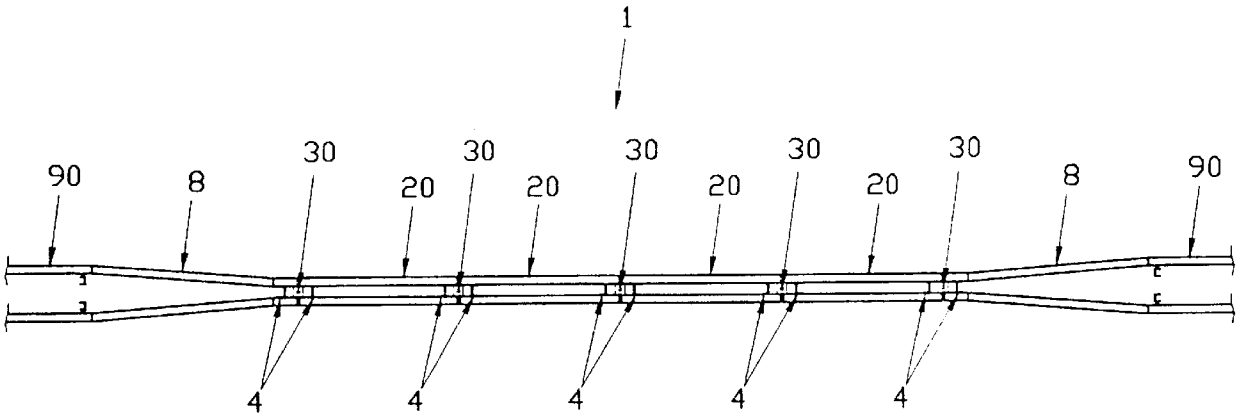
FIG. 2 schematically shows a road gap with the barrier transition according to the invention, as seen by a top plan view.
Figure 4:
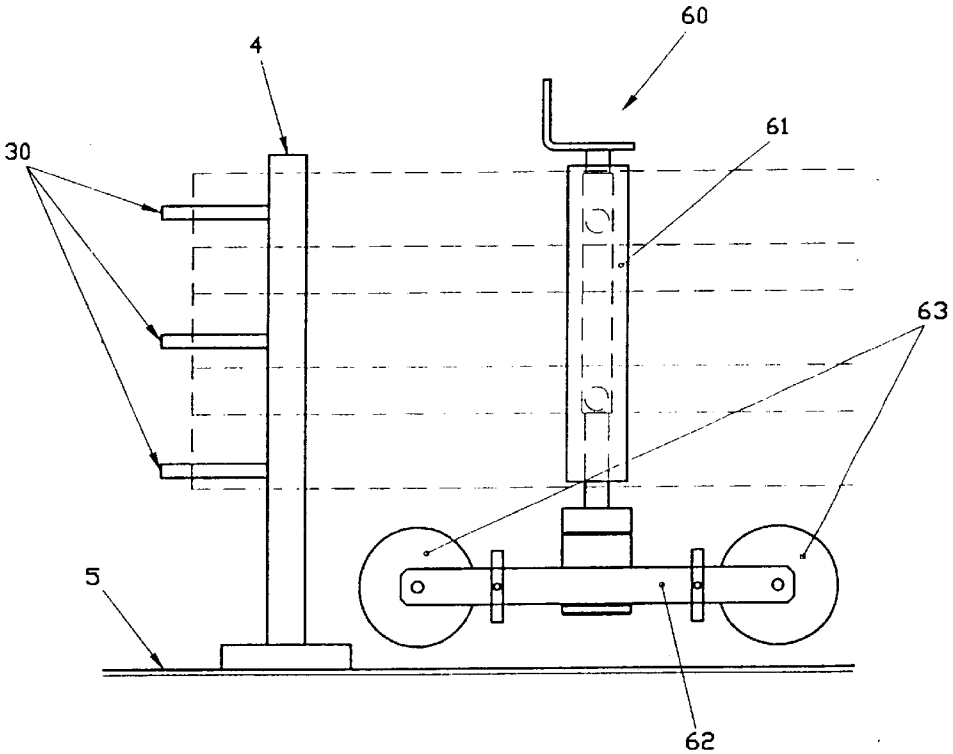
FIG. 4 is an elevation view showing a foot element including an optional wheel lifting system in a rest condition thereof.
Figure 3:
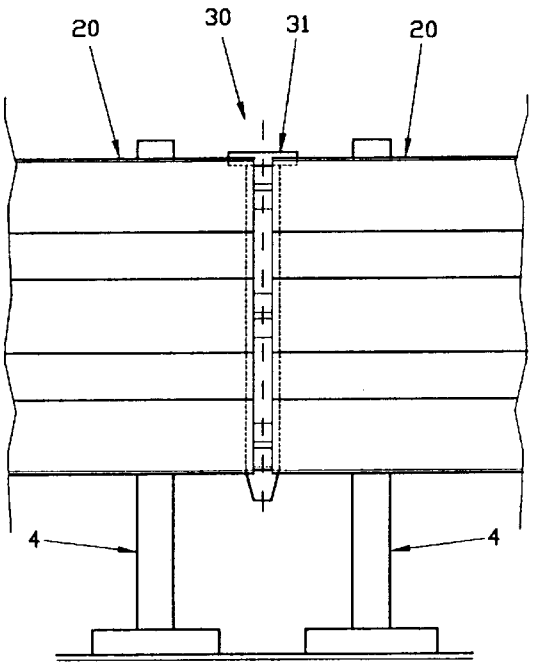
FIG. 3 is an elevation view showing a connection of two component elements of the barrier transition.
Figure 6:
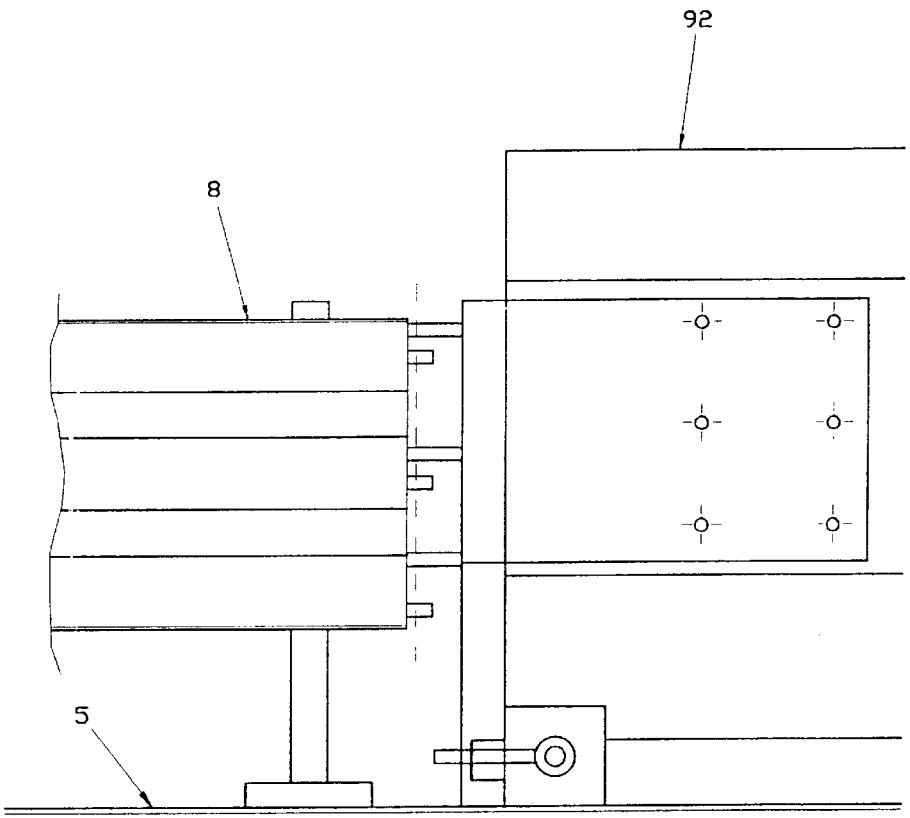
FIG. 6 is a further schematic elevation view showing a connection to a fixed concrete barrier.
Figure 5:
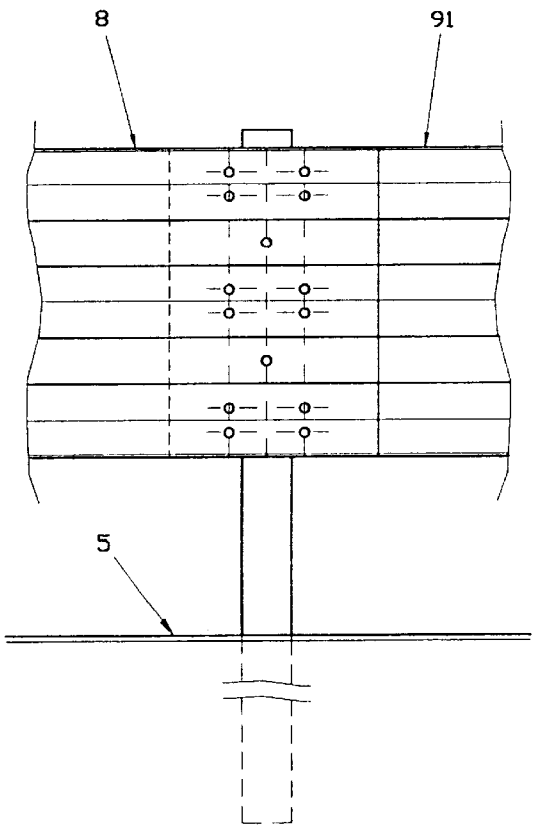
FIG. 5 is a further schematic elevation view showing a connection to a fixed metal barrier.
Figure 7:
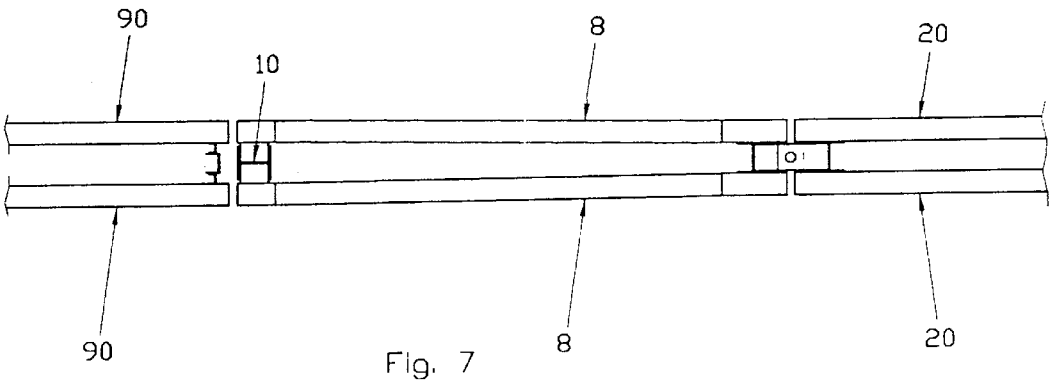
FIG. 7 shows a connection of an end or terminal portion to a ground driven pole inside the fixed barrier.
Figure 8:
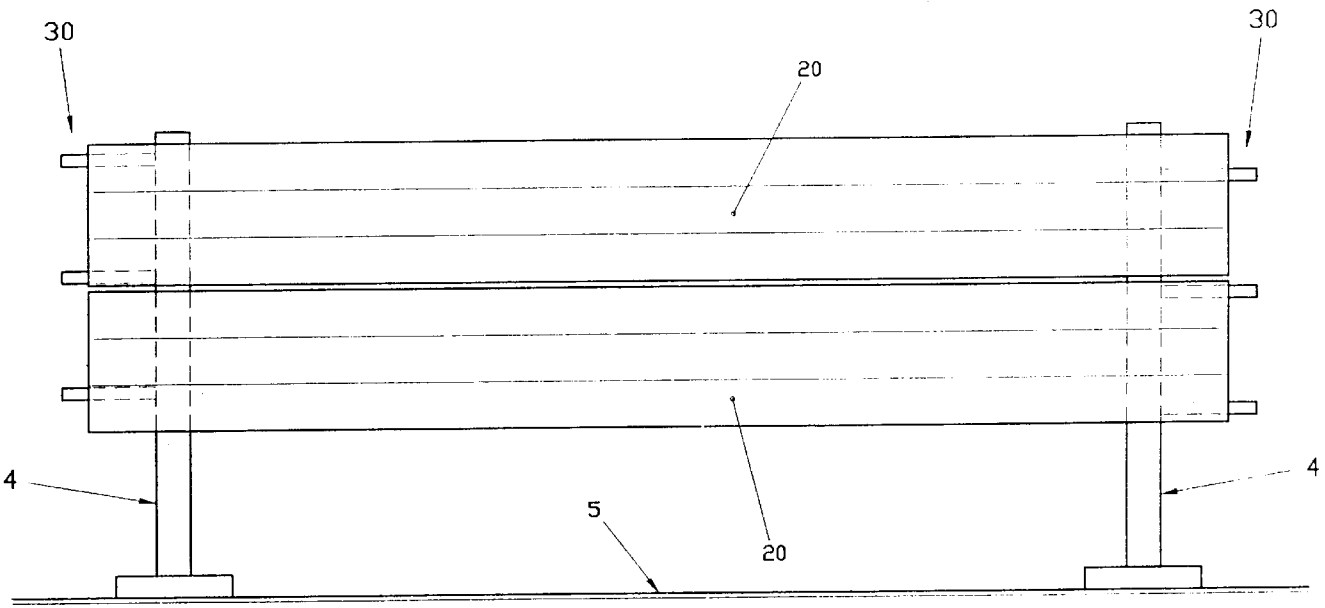
FIG. 8 is a further schematic elevation view showing a barrier transition segment with overlapped double corrugation elements.

With reference to the number references of the above mentioned figures, the barrier transition for removably closing road gaps, according to the invention, which has been generally indicated by the reference number 1, comprises longitudinal elements 20, made by coupling two barrier sections, and connected to one another by a hinge assembly 30, the removable pin 31 of which constitutes a disengagement element for opening the road gap at one or more points.

Each element 20 is supported on the ground by two supporting feet 4 which can freely slide on the ground 5. To facilitate the barrier opening movement, said transition barrier can optionally comprise, either fully or partially, a lifting and sliding system 60, arranged near the feet 4 and comprising an adjustable lifting device 61, so designed as to turn about a vertical axis passing through a hub 62, and further including one or more wheels 63 for only contacting the ground as the road gap is opened.

The terminal or end elements 8 are conventionally bolted to an existing fixed barrier 90, which can be either metal barrier 91 or a concrete barrier 92.

If said existing barrier is considered as excessively weak, then the terminal elements 8 are suitably modified at their end portions for coupling to a strong ground driven pole 10.

According to another embodiment, designed to protect the existing barrier end portion from front impacts due to vehicles passing through the barrier gap, the end portion of the barrier terminal can be constructed, by any prior method, so as to absorb impacts.

From the above disclosure it should be apparent that the invention fully achieves the intended objects.

In particular, a barrier transition has been provided which is designed to absorb angled impacts from vehicles, meeting, for example, the European standard EN 1317, and which can be essentially dynamically deformed so as to guide an impacting vehicle to its carriageway again. Moreover the barrier has a stiffened construction and operates in an elastic range, in order to achieve small side dynamic deformation (camber), thereby increasing the safety level of the transition.

Moreover, the connection with respect to the fixed barrier is such as to provide a gradual deformation of the fixed barrier, thereby preventing any dangerous hard points from occurring.

With respect to the required maintenance interventions, since no foundation construction is necessary for anchoring and tensioning purposes, the existing barrier can be easily modified by only two maintenance operators who can use an optional service vehicle and related tooling.

Likewise, if the road gap is to be opened, the same operators can disengage either one or more element connections, lower the optionally provided wheels, for facilitating the sliding thereof, and quickly open the system as a book either from a part or from the other, or from both parts.

According to preferred embodiments, the corrugated panels are arranged from the ground at a maximum height of 600 to 1,200 mm and preferably from 800 to 1,100 mm.

Moreover, the panels can have any desired contour and moment of inertia, even with barriers of closed circular or polygonal cross-section.

To render the barrier more visible at the road gap, the longitudinal elements can be colored or decorated with patterns, to allow the closure region to be clearly seen.

The invention, as disclosed, is susceptible to several modifications and variations, all of which will come within the scope of the invention.

Moreover, all the details can be replaced by other technically equivalent elements.

In practicing the invention, the used materials, as well as the contingent size and shapes, can be any, depending on requirements.

What is claimed is:

1. A transition between two fixed safety barriers, which can be either fully or partially easily opened, comprising a bilateral protective barrier including a plurality of longitudinal rigid element assemblies, each made by coupling two barrier sections by a hinge assembly, each longitudinal rigid element assembly comprising two longitudinal rigid elements, each longitudinal rigid element being supported two supporting sliding feet which can freely slide on a ground on which said barrier is installed, each said longitudinal rigid element comprising a contoured longitudinal strip and said hinge assembly comprising a single vertical removable pin engaged in preformed plates fixed to said longitudinal rigid elements, said vertical removable pin being adapted to be removed to remove one or more of said longitudinal rigid elements, at least some of said feet comprising a plurality of wheels, a lifting mechanism being moreover provided for adjusting a height of said wheels to contact said ground only as said bilateral protective barrier is opened by removing one or more of said longitudinal rigid elements, said lifting mechanism being coupled either to said feet or to said longitudinal rigid elements.

2. A barrier transition, according to claim 1, wherein said longitudinal rigid elements are made of a steel material surface processed as to render said barrier clearly visible.

3. A barrier transition, according to claim 1, wherein at least one of said longitudinal rigid elements, arranged at an end portion of sad barrier is coupled to at least a pole driven into said ground.

4. A barrier transition, according to claim 1, wherein said longitudinal rigid elements have top portions arranged at a height of 600 to 1,200 mm from the ground.

* * * * *

UNITED STATES PATENT AND TRADEMARK OFFICE

CERTIFICATE OF CORRECTION

PATENT NO. : 6,712,545 B2
APPLICATION NO. : 10/095798
DATED : March 30, 2004
INVENTOR(S) : Franz Muller et al.

It is certified that error appears in the above-identified patent and that said Letters Patent is hereby corrected as shown below:

On the title page

Item (76) The addresses of the both inventors Franz Muller and Marco Anghileri should read Via F. Baracca, 23 not Via F. Bracca, 23

Signed and Sealed this

Sixth Day of May, 2008

JON W. DUDAS
*Director of the United States Patent and Trademark Office*